United States Patent [19]

Sarcia

[11] 4,388,809

[45] Jun. 21, 1983

[54] CRYOGENIC REFRIGERATOR

[75] Inventor: Domenico S. Sarcia, Carlisle, Mass.

[73] Assignee: CVI Incorporated, Columbus, Ohio

[21] Appl. No.: 369,864

[22] Filed: Apr. 19, 1982

[51] Int. Cl.[3] ..... F25B 9/00

[52] U.S. Cl. ..... 62/6; 60/520; 137/624.13; 137/625.35

[58] Field of Search ..... 62/6; 60/520; 137/624.13, 625.35

[56] References Cited

U.S. PATENT DOCUMENTS

| | | | |
|---|---|---|---|
| 2,966,035 | 12/1960 | Gifford | 62/6 |
| 3,188,818 | 6/1965 | Hogan | 62/6 |
| 3,188,821 | 6/1965 | Chellis | 62/6 |
| 3,218,815 | 11/1965 | Chellis et al. | 62/6 |
| 4,305,741 | 12/1981 | Sarcia | 62/6 |
| 4,339,927 | 7/1982 | Sarcia | 62/6 |

*Primary Examiner*—Ronald C. Capossela

*Attorney, Agent, or Firm*—Seidel, Gonda, Goldhammer & Panitch

[57] ABSTRACT

The cryogenic refrigerator includes a movable displacer within an enclosure having first and second chambers of variable volume. A refrigerant fluid is circulated in a fluid path between said chambers by movement of the displacer. A spool valve controls introduction of high pressure fluid and low pressure fluid. The displacer movement is controlled by an electric motor.

14 Claims, 8 Drawing Figures

CRYOGENIC REFRIGERATOR

BACKGROUND

The present invention is an improvement on the Gifford-McMahon cycle. Familiarity with said cycle is assumed. Representative prior art patents teaching such cycle include U.S. Pat. Nos. 2,966,035; 3,188,818; 3,218,815; and 4,305,741.

For maximum efficiency and reliability, it is important to have maximum gas volume transfer through the regenerator. In order that this may be attained, it is important that the direction of gas flow be reversed when the displacer is at top dead center or bottom dead center. The present invention is directed to a solution of that problem by utilizing an electric motor to control the position of the displacer adjacent top dead center and bottom dead center in combination with a slidable pressure responsive valve for controlling fluid flow.

SUMMARY OF THE INVENTION

The present invention is directed to a cryogenic refrigerator in which a movable displacer defines within an enclosure first and second chambers of variable volume. A refrigerant fluid is circulated in a fluid flow path between the first chamber and the second chamber by movement of the displacer.

The refrigerator includes chamber means for guiding a slide having an axial passage. The slide is connected to the displacer. A motor is connected to the slide for controlling movement of the displacer.

The passage in the slide has a restriction. A valve is provided with a spool valve member for controlling flow of the high and low pressure fluid. Means is provided including a conduit communicating one end of the spool valve member with the end of said chamber means remote from said displacer for introducing high fluid pressure into the conduit to shift the spool valve member when the displacer is at bottom dead center.

It is an object of the present invention to provide a cryogenic refrigerator wherein efficiency and reliability are improved by controlling movement of the displacer by the combination of a motor which controls the displacer at top dead center and bottom dead center.

It is another object of the present invention to provide a cryogenic refrigerator which has both a refrigeration mode and a heat generating mode.

Other objects and advantages will appear hereinafter.

For the purpose of illustrating the invention, there is provided in the drawing a form which is presently preferred; it being understood, however, that this invention is not limited to the precise arrangements and instrementalities shown.

DETAILED DESCRIPTION OF FIRST EMBODIMENT

Figure 1:
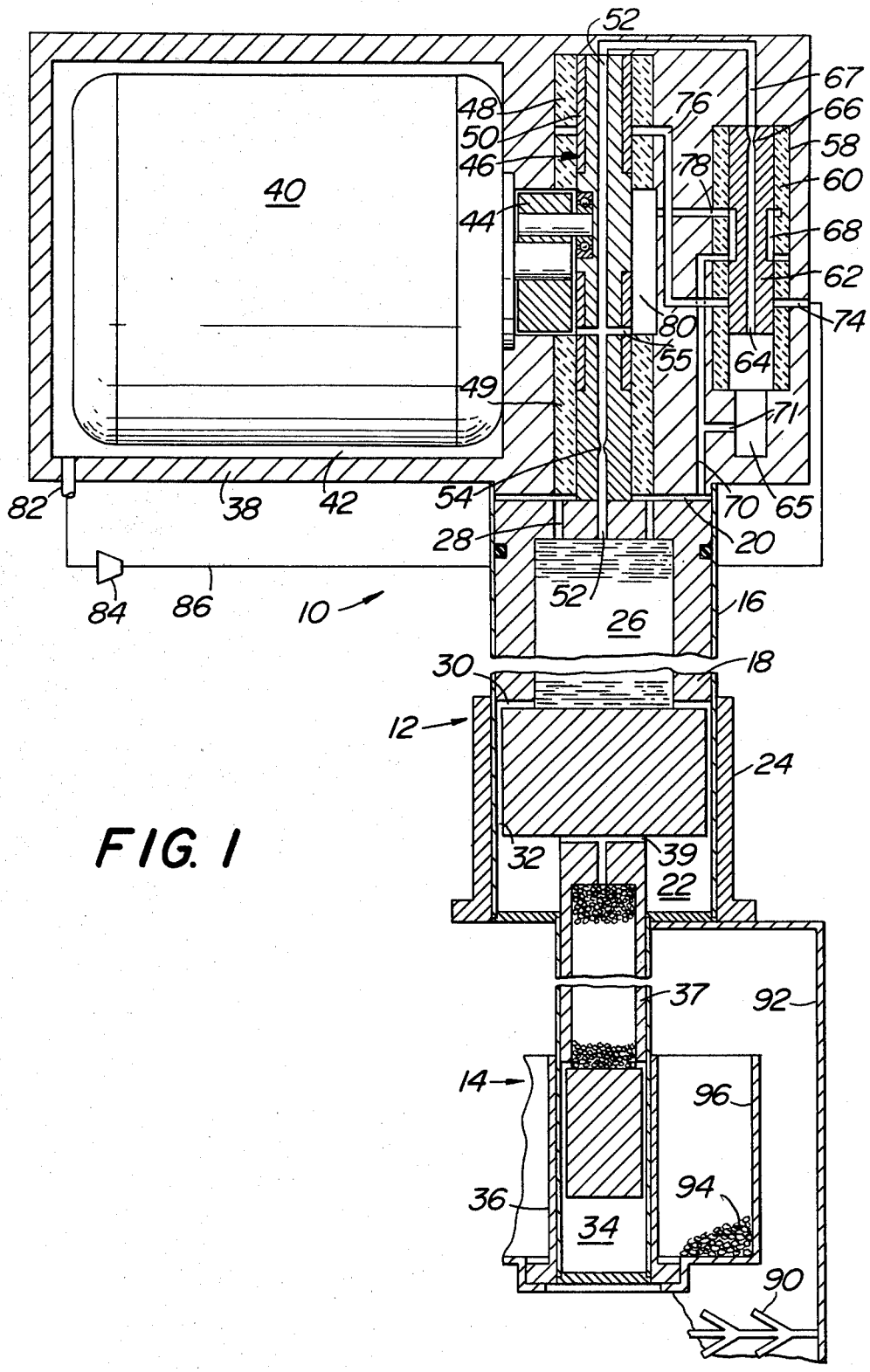
FIG. 1 is a vertical section view of a refrigerator in accordance with a first embodiment of the present invention with the displacer at top dead center position.

Referring to the drawings in detail, wherein like numerals indicate like elements, there is shown a refrigerator in accordance with the present invention designated generally as 10. As illustrated, the refrigerator 10 has a first stage 12 and a second stage 14. When in use said stages are disposed within a vacuum housing not shown. It is within the scope of the present invention to have one or more of such stages. Each stage includes a housing such as housing 16 within which is provided a displacer 18. The displacer 18 has a length less than the length of the housing 16 so as to define a warm chamber 20 thereabove and a cold chamber 22 therebelow. The designations warm and cold are relative as is well known to those skilled in the art.

A heat station 24 in the form of a tube having a flanged ring and made from a good heat conductive material is attached to the housing 16 and surrounds the cold chamber 22. Heat station 24 may have other constructions as is well known to those skilled in the art.

Within the displacer 18, there is provided a regenerator 26 containing a matrix. Ports 28 communicate the upper end of the matrix in regenerator 26 with the warm chamber 20. See FIG. 2. Radially disposed ports 30 communicate the lower end of the matrix in regenerator 26 with a clearance space 32 disposed between the outer periphery of the lower end of the displacer 18 and the inner periphery of the housing 16. Thus, the lower end of the matrix in regenerator 26 communicates with the cold chamber 22 by way of ports 30 and clearance 32 which is an annular gap heat exchanger.

The matrix of the regenerator 26 is preferably a stack of 250 mesh material having high specific heat such as oxygen free copper. The matrix has low void area and low pressure drop. The matrix may be other materials such as lead spheres, nylon, glass, etc. may be used.

The second stage 14 is substantially the same as the first stage 12. In the second stage, the cold chamber is designated 34 and is surrounded by the heat station 36. Insofar as the second stage 14 is concerned, the warm chamber thereof is chamber 22. The displacer 37 of the second stage 14 is fixedly connected to the displacer 18. The regenerator of the second stage 14 communicates with the chamber 22 by way of the ports 39 and contains a matrix of lead spheres.

An electrical motor 40 is disposed within a motor housing 38. Housing 16 depends downwardly from housing 38. The output of motor 40 is connected to a cam 44. Cam 44 has a follower disposed within a transverse slot of slide 46. Slide 46 is of uniform diameter and is connected to the upper end of the displacer 18.

Figure 2:
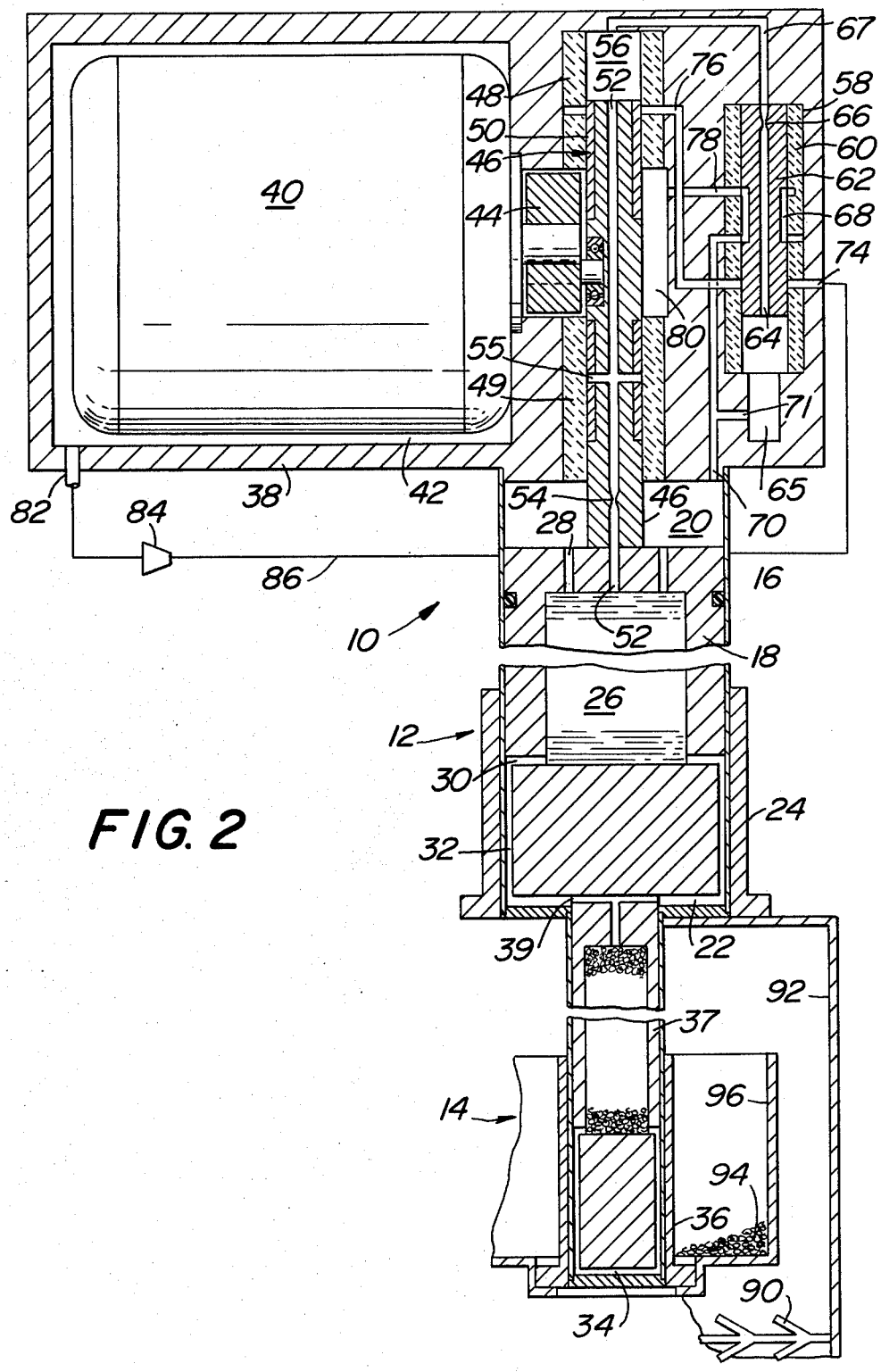
FIG. 2 is a view similar to FIG. 1 but showing the displacer as it approaches bottom dead center.

The slide 46 is surrounded by and guided by clearance seal sleeve bearings 48 and 49 attached to the housing 38. Bearings 48 and 49 are preferably made from a ceramic material. Slide 46 has cylindrical bearing inserts 50 in sliding contact with the inner periphery of the sleeve bearing 48. An axial flow passage 52 is provided in the slide 46. Slide 46 is longer than the sleeve bearing 48 and has radial ports 55 located above a restriction 54 in the passage 52. When the slide 46 is below top dead center, as shown in FIG. 2, the chamber means thereabove and within the bearing 48 is designated 56.

The housing 38 includes a bore 58 parallel to the slide 46. Within the bore 58 there is provided a clearance seal sleeve bearing 60 preferably made from a ceramic material. Within the sleeve bearing 60, there is provided a reciprocable spool valve member 62 having an axial flow passage 64. It will be noted that the member 62 has a length less than the length of the sleeve bearing 60 so that passage 64 communicates with chamber 65 therebelow.

Adjacent the upper end of member 62, there is provided a restriction 66 in passage 64. The upper end of the passage 64 communicates with chamber 56 by way of conduit 67. A groove 68 is provided on the outer periphery of spool valve member 62. In the position of spool valve member 62 as shown in FIG. 1, one end of groove 68 communicates with the warm chamber 20 by way of passage 70. Passage 70 communicates with chamber 65 via passage 71. A high pressure port 74 is provided in housing 38 and is blocked by the spool valve member 62 in the position thereof as shown in FIG. 1. As will be made clear hereinafter, port 74 is adapted to communicate with chamber means 56 by way of passage 76 when the displacer 18 is at bottom dead center.

In the position of the spool valve member 62 as shown in FIG. 1, the upper end of the groove 68 communicates with a port 78 on the inner periphery of the sleeve bearing 60. Port 78 communicates directly with chamber 80. Ports 55 of slide 46 communicate with chamber 80 when slide 46 is at top dead center. See FIG. 1. Chamber 80 communicates directly with chamber 42 within which the motor 40 is disposed. Chamber 42 communicates by way of port 82 with the suction side of a compressor 84. The output from compressor 84 communicates by way of conduit 86 with the high pressure port 74.

The housing 38 is constructed of a number of components so as to facilitate machining of the housing, assembly, and access to the spool valve member 62 and slide 46. The manner in which housing 38 is comprised of a plurality of components is not illustrated but will be obvious to those skilled in the art. The refrigerator 10 is preferably designed for use with a cryogenic fluid such as helium but other fluids such as air and nitrogen may be used. The refrigerator 10 was designed to have a wattage output of at least 65 watts at 77° K. from stage 12 and a minimum of 5 watts at 20° K. at stage 14.

Multi-staging is a thermodynamically efficient process to attain cryogenic refrigeration temperatures at different levels. For a given refrigeration requirement, there is a decreased power requirement.

Operation Of First Embodiment

As shown in FIG. 1, the displacers 18 and 37 are at top dead center and under the control of the motor 40. Spool valve member 62 has just moved to its uppermost position wherein chamber 20 communicates with the suction side of compressor 84 by way of passage 70, ports 78, and chambers 80 and 42. Motor 40 is cooled by the gas flowing through chamber 42. The chamber 65 below spool valve member 62 is also exhausted by way of passage 64, conduit 67, passage 52 and chamber 80.

As the displacers begin to move downwardly by motor 40, the cold low pressure gas in chambers 22, 34 moves upwardly through the respective regenerators and is exhausted. As the gas moves up through passage 32 into the regenerators, it absorbs heat from heat station 24 and the regenerators thereby cooling the regenerators. As shown in FIG. 2, the displacers are moving down and approaching bottom dead center. When the upper end of slide 46 uncovers passage 76, the displacers will be at bottom dead center. Accuracy in locating the passage 76 directly effect efficiency. High pressure gas from port 74 now flows from passage 76 to chamber means 56 and conduit 67. The pressure between restrictors 54 and 66 increases. When the high pressure gas overcomes the low pressure fluid trapped in chamber 65, member 62 descends to the position shown in FIG. 3. Now the entire system contains high pressure gas. The displacers are at bottom dead center.

The function of the regenerators in said displacers 18 and 37 is to cool the gas passing downwardly therethrough and to heat gas passing upwardly therethrough. In passage downwardly through the regenerators, the gas is cooled thereby causing the pressure to decrease and further gas to enter the system to maintain the maximum cycle pressure. The decrease in temperature of the gas in the chambers 22, 34 is useful refrigeration which is sought to be attained by the apparatus at heat stations 24, 36. As the gas flows upwardly through the regenerators, it is heated by the matrix to near ambient temperature thereby cooling the matrix.

Figure 3:
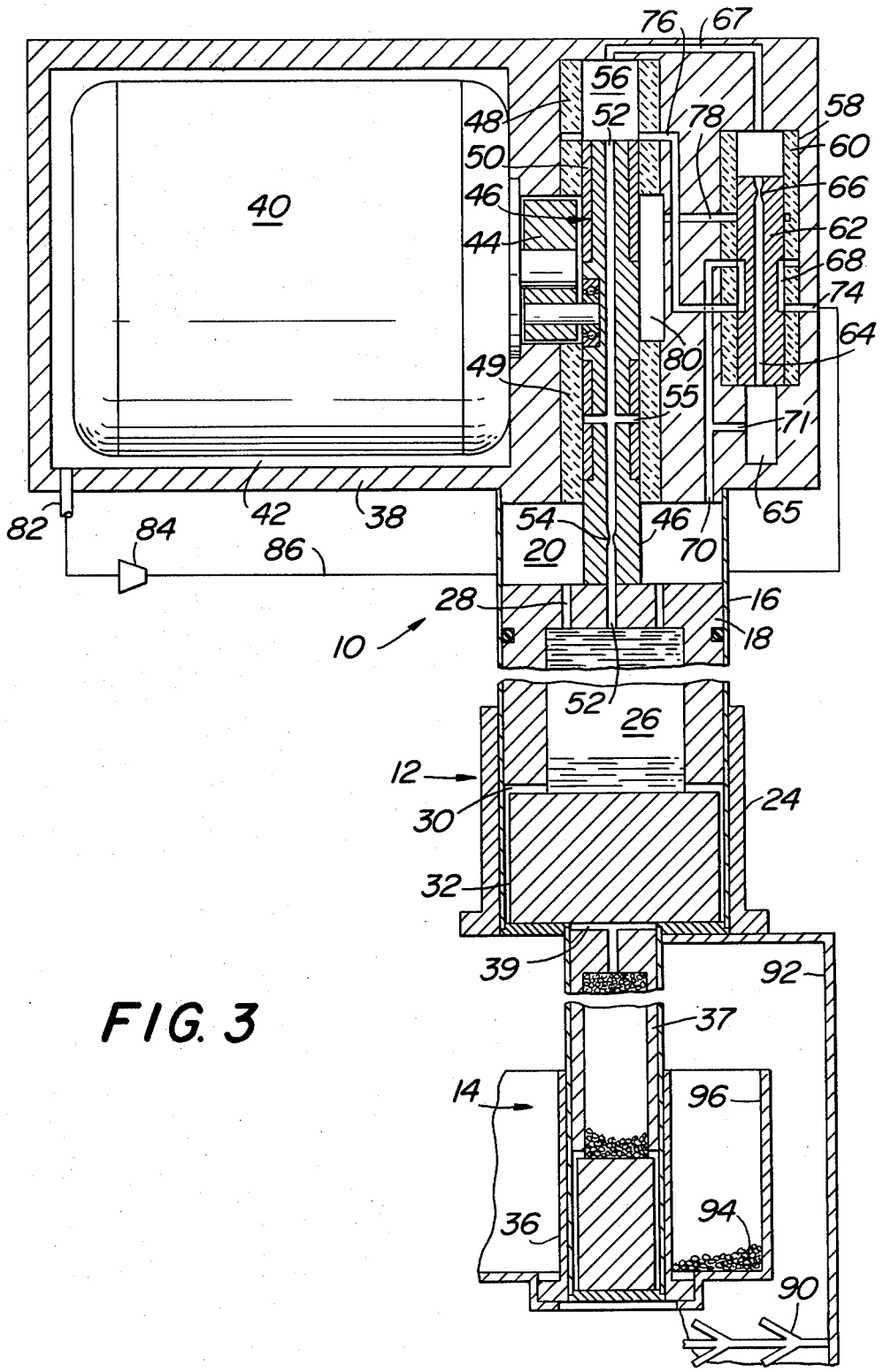
FIG. 3 is a view similar to FIG. 1 but showing the displacer at bottom dead center.

The side 46 is moved upwardly from bottom dead center as shown in FIG. 3 with the displacers 18 and 37 by motor 40 as high pressure gas moves downwardly into chambers 20 and 34. Port 55 communicates with chamber 80 just before top dead center is reached. The upper end of bearing 49 may be removed and machined or made vertically adjustable to fine tune the timing of communication between port 55 and chamber 80. This immediately places passage 52 and conduit 67 in communication with the suction side of the compressor 84. The high pressure gas trapped in chamber 65 raises the spool valve member 62 from the position shown in FIG. 3 to the position shown in FIG. 1 as the displacers reach top dead center. One cycle is now complete. A typical embodiment operates at the rate of 72–80 cycles per minute. The length of the stroke of the movable members is short such as 12 mm for valve member 62 and 30 mm for the displacers. Valve member 62 need not have axial flow passage 64 but instead may be a solid spool valve member which responds to differential pressure.

Figure 7:
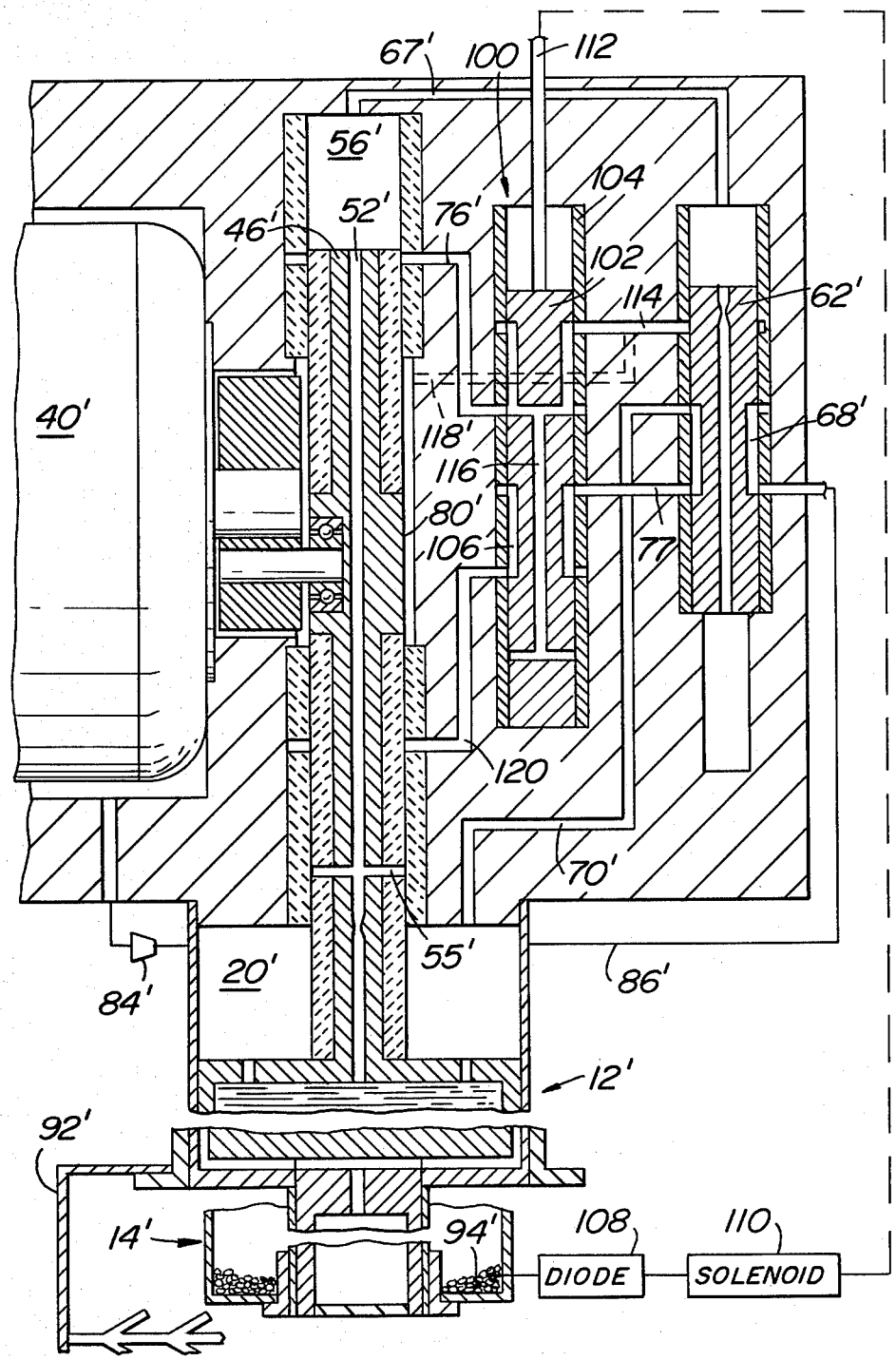
FIG. 7 is a similar view to FIG. 4 but showing the displacer adjacent bottom dead center.

The refrigeration available at heat stations 24 and 36 may be used in connection with a wide variety of devices. As shown in FIG. 7, heat station 24 is used to cool chevron vanes 90 supported on cryopump housing 92 and heat station 36 is used to cool charcoal 94 in pan 96. In a cryopump, vanes 90 are optically dense and cause gases such as oxygen and nitrogen to adhere thereto. Nobel gases are absorbed by the charcoal 94.

Description Of Second Embodiment

In FIGS. 4–8 there is illustrated another embodiment designated generally as 10'. The refrigerator 10' is the same as refrigerator 10 except as will be set forth hereinafter. Hence, corresponding elements of refrigerator 10' are designated with corresponding primed numerals.

Figure 4:
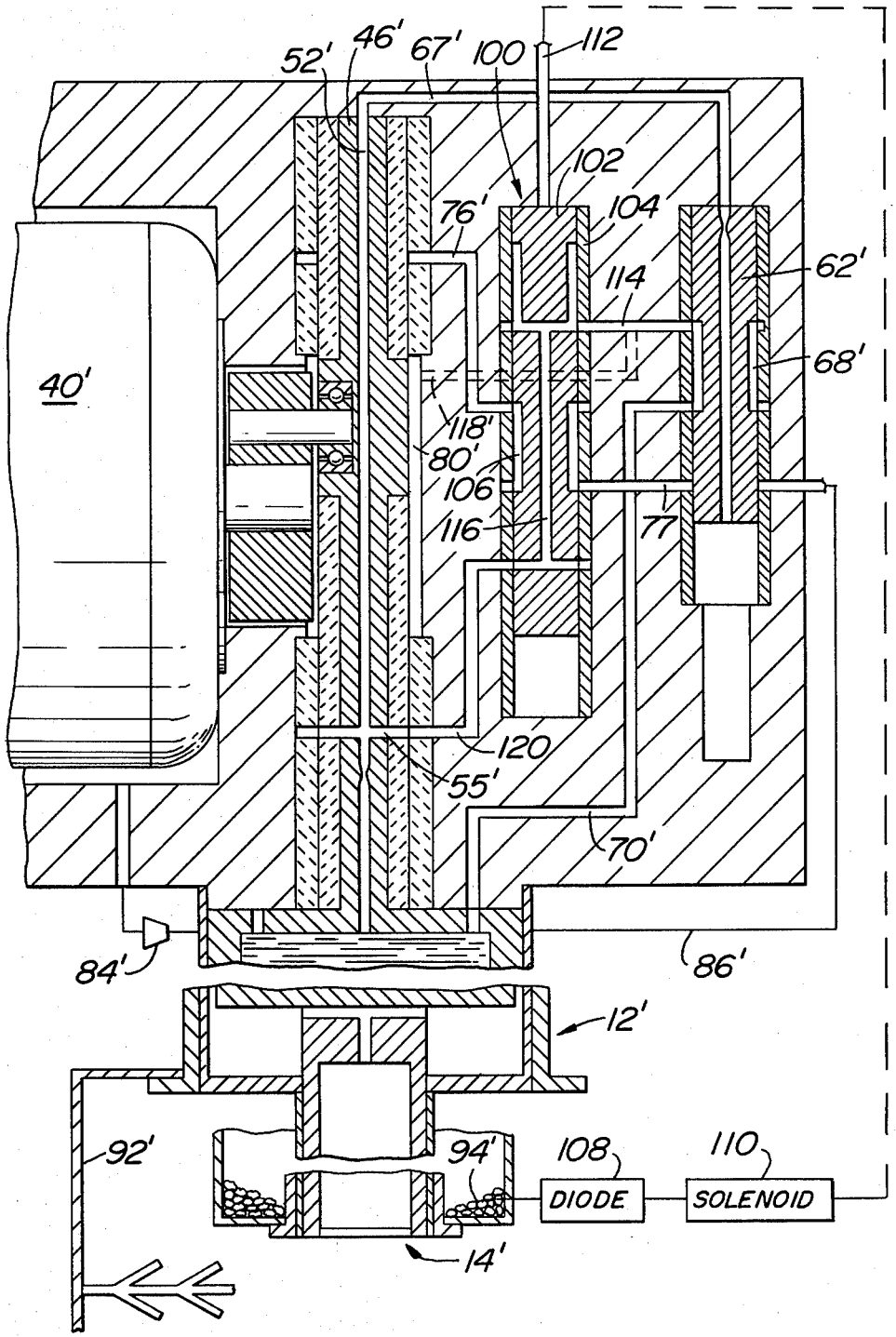
FIG. 4 is a view similar to FIG. 1 but showing another embodiment of the present invention.

A pilot valve 100 is provided between the slide 46' and the valve member 62'. The valve 100 includes a spool valve member 102 within a ceramic bearing 104. The valve member 102 has a circumferential groove 106 which may selectively interrupt the communication along passage 76. As illustrated in FIG. 4, high pressure is provided in conduit 77, groove 106 and passage 120 but blocked by the slide 46' and valve member 52'. The remainder of the system is at low pressure.

The spool valve member 102 remains in the position as illustrated in FIG. 4 during the entire refrigeration cycle as described above. When the charcoal 94' can no longer absorb nobel gases, due to reaching a saturation point, the nobel gases have no place to go. The nobel gases collide around and find their way back into the pump. This puts a conductive load on the second stage which heats up. When the temperature of the second stage reaches about 20° K., a diode 108 is triggered. Diode 108 closes contacts in solenoid 110. Solenoid 110 is connected to rod 112 which in turn is connected to the valve member 102. As a result thereof, the valve member 102 is shifted from the position shown in FIG. 4 to the position shown in FIG. 5. This immediately reverses the effect of valve member 62' whereby the apparatus is now in a heating mode.

Figure 5:
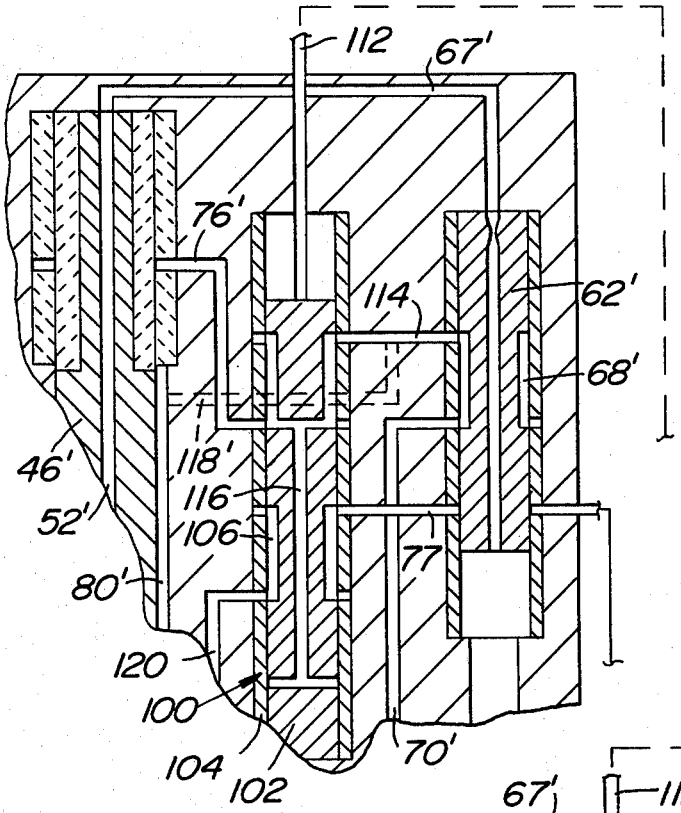
FIG. 5 is a view similar to FIG. 4 but showing the displacer as it approaches bottom dead center.
Figure 6:
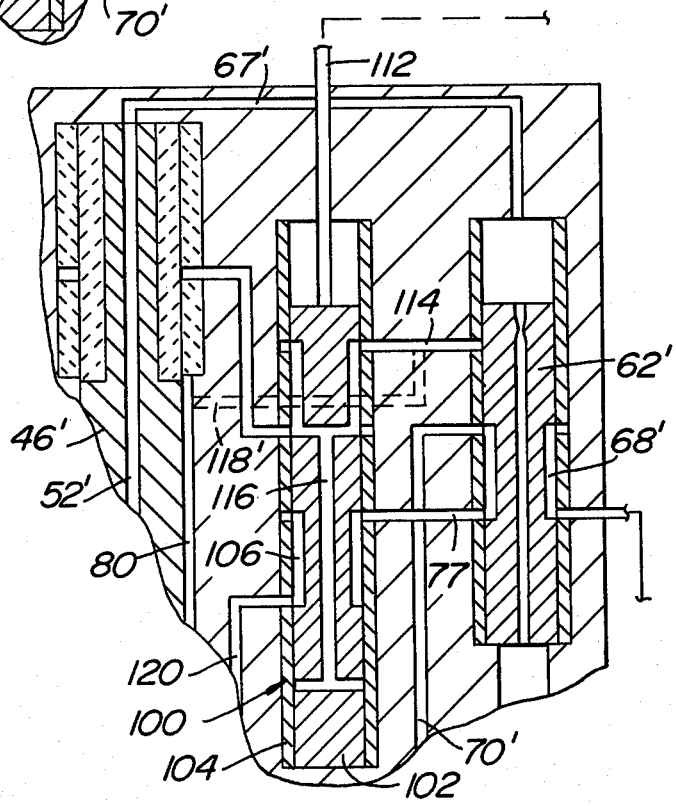
FIG. 6 is a view similar to FIG. 4 but showing the displacer at bottom dead center.

As shown in FIG. 5, it is assumed that the shifting of valve member 102 occurred while the slide 46' was at top dead center. Due to the slight pressure differential, the high pressure gas in passage 67' causes the slide valve member 62' to move from the position shown in FIG. 5 to the position shown in FIG. 6. The apparatus 10' is now in a heating mode instead of a refrigerating mode with the displacers at top dead center. High pressure gas exists in all of the passages except for passages 114 and 116. As the pressure in the cold volume increases, the temperature of the gas rises.

Figure 8:
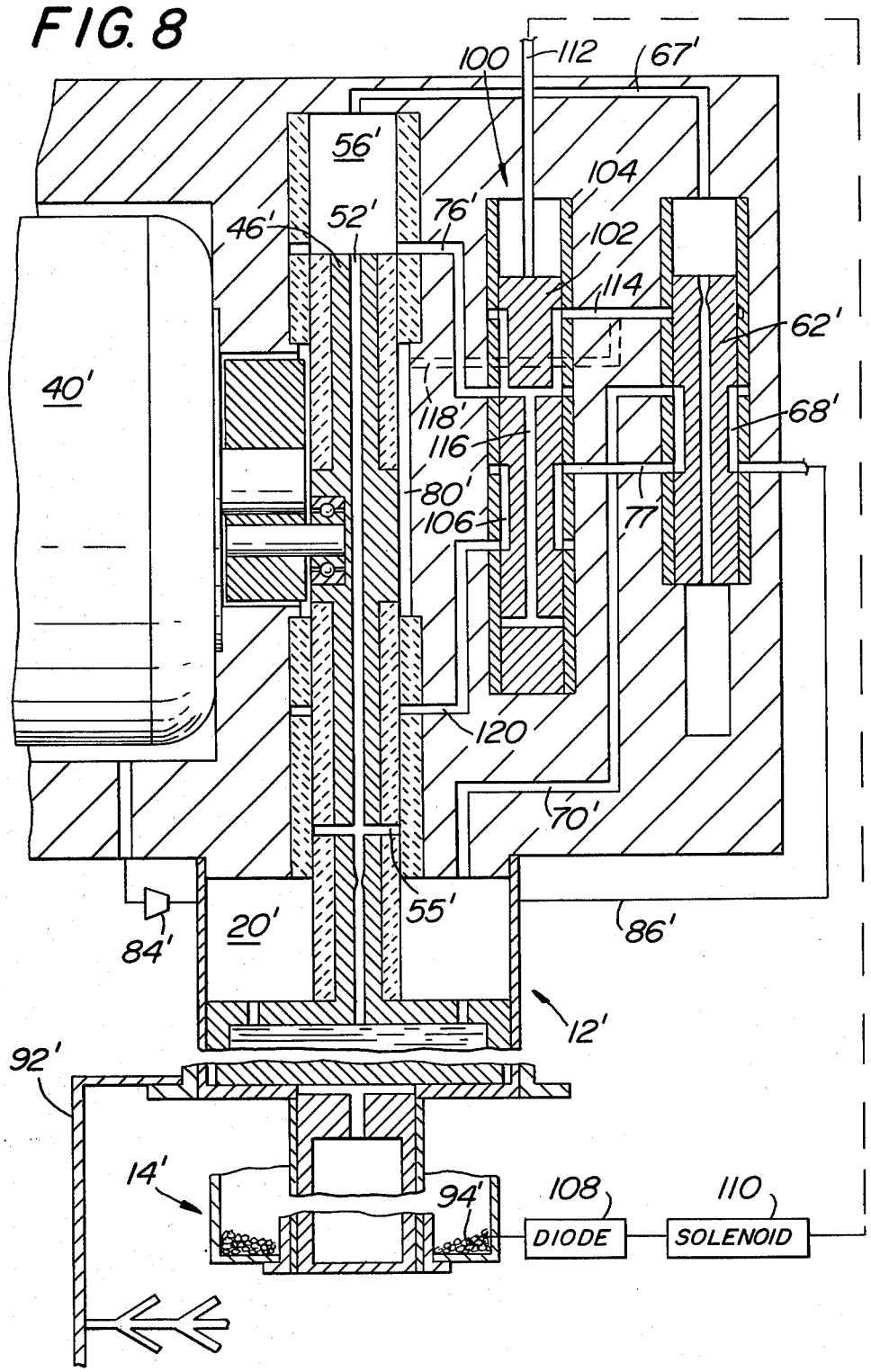
FIG. 8 is a similar view to FIG. 4 but showing the displacer at bottom dead center.

As the displacer begins to move downwardly toward the cold end, the relatively warm gas is moved upwardly through the regenerator matrix thereby heating the matrix material in each of the stages. As the displacers are continued to move downwardly to a bottom dead center, the low pressure control port is about to open as shown in FIG. 7. As shown in FIG. 8, the displacers are at bottom dead center.

As shown in FIG. 8, when the displacers are at bottom dead center chamber 56' communicates with passage 114 which in turn communicates with chamber 80 whereby the space above valve member 62', conduit 67', chamber 56', and passage 52' down to the restriction is at low pressure. High pressure gas is communicated by way of passage 70' to the first and second stages. Due to a slight momentary pressure differential across valve member 62' it is forced upwardly from the position shown in FIG. 8 to the position shown in FIG. 5. At this point in time, the entire system is connected low pressure except for conduit 76' which communicates through the valve member 102 but is blocked at the lefthand end by the slide 46'. The high pressure warm gas above the displacers is expanded out passage 70', groove 68', through passage 118' to the chamber 80 and through the motor housing, to the inlet or suction side of the compressor 84'. Thereafter, the displacers begin to move upwardly under the influence of motor 40' thereby forcing the low pressure relatively warm gas down through the regenerators in the first and second stages.

As the displacers are moved upwardly, the slide 46' closes off the lefthand end of passage 114 and thereafter continue moving toward top dead center. When the displacers reach top dead center as shown in FIG. 4, high pressure will be introduced from conduit 76' into groove 106, through passage 120 to port 55', through passage 52', chamber 56', conduit 67' and to the restriction in the valve member 62'. The remainder of the system will be at low pressure communicating with the inlet side of the compressor 84'. One cycle has now been completed. In an operative embodiment, there would approximately 72 to 80 cycles per minute.

The heating cycle will be terminated wherever the solenoid 110 moves the valve member 102 to the position shown in FIG. 4 thereby placing the apparatus back into a refrigerating mode. The diode 108 will trigger the solenoid 110 when it is desired to revert to a refrigeration mode. The heating mode will take approximately 35 minutes. All gases and moisture liberated within housing 92' will be pumped away. Regeneration of charcoal 94' within approximately 35 minutes is a substantial advancement over present techniques which require at least $3\frac{1}{2}$ hours. Embodiment 10' utilizes the existing flow passages in connection with the pilot valve 100 to provide more efficient use of sizes of passages and associated flow rates.

The present invention may be embodied in other specific forms without departing from the spirit or essential attributes thereof and, accordingly, reference should be made to the appended claims, rather than to the foregoing specification, as indicating the scope of the invention.

I claim:

1. In a cryogenic refrigerator in which a movable displacer means defines within an enclosure first and second chambers of variable volume, and in which a refrigerant fluid is circulated in a fluid flow path between said first chamber and said second chamber by the movement of said displacer means, the improvement comprising chamber means for guiding a slide connected to the displacer means, said slide having an axial passage communicating with one end of said chamber means remote from the displacer means, a motor coupled to said slide for controlling movement of the displacer means at top dead center and bottom dead center positions thereof, said passage in said slide having a restriction, a valve having a spool valve member for controlling flow the high and low pressure fluid, means including a conduit communicating one end of said spool valve member with said one end of said chamber means for introducing high fluid pressure into the conduit to shift the spool valve member when the displacer means is at one of the extremities of its movement.

2. Apparatus in accordance with claim 1 wherein said last mentioned means is arranged to shift the spool valve member when the displacer means is at bottom dead center.

3. Apparatus in accordance with claim 1 wherein said last mentioned means is arranged to shift the spool valve member when the displacer means is at top dead center.

4. Apparatus in accordance with claim 1 including means for selectively converting said refrigerator to a heater by controlling flow between said spool valve member and said one end of said chamber means.

5. Apparatus in accordance with claim 1 wherein said spool valve member has an axial passage containing a restriction therein adjacent the end thereof communicating with the conduit.

6. Apparatus in accordance with claim 1 wherein low pressure fluid is discharged through a housing for said motor for cooling said motor.

7. Apparatus in accordance with claim 1 including a ceramic clearance seal sleeve bearing for said slide and spool valve member.

8. Apparatus in accordance with claim 1 including passage means for venting said passage in each of said slide and said conduit as the displacer means approaches top dead center to thereby enable the spool valve member to reverse its positions with respect to high and low pressure.

9. A cryogenic refrigerator comprising a movable displacer within an enclosure having first and second chambers of variable volume and in which a refrigerant fluid is circulated in a fluid flow path between said first chamber and said second chamber by the movement of said displacer, chamber means for guiding a slide connected to the displacer, said slide having an axial passage communicating with one end of said chamber means remote from the displacer and said first chamber, an electrical motor coupled to said slide intermediate its ends for controlling movement of the displacer at top dead center and bottom dead positions thereof, said passage in said slide having a restriction, a valve having a spool valve member for controlling flow the high and low pressure fluid, means including a conduit communicating one end of said spool valve member with said one end of said chamber means for introducing high pressure fluid into the conduit to shift the spool valve member when the displacer is at bottom dead center, said spool valve member having an axial passage containing a restriction therein adjacent the end thereof communicating with the conduit.

10. Apparatus in accordance with claim 9 wherein low pressure fluid is discharged through a housing for said motor for cooling said motor.

11. Apparatus in accordance with claim 9 including a ceramic clearance seal sleeve bearing for said slide and spool valve member.

12. Apparatus in accordance with claim 9 including passage means for venting said passage in said slide and said conduit as the displacer approaches top dead center to thereby enable the spool valve member to reverse its positions with respect to high and low pressure.

13. Apparatus in accordance with claim 9 wherein said displacer has a hollow portion containing a matrix, and said displacer having ports for communicating said first chamber with said second chamber via said matrix and vice versa.

14. A cryogenic refrigerator system comprising a movable displacer within an enclosure having first and second chambers of variable volume and in which a refrigerant fluid is circulated in a fluid flow path between said first chamber and said second chamber by the movement of said displacer, a heat station at one of said chambers for transmitting a low temperature, chamber means for guiding a slide connected to the displacer, said slide having an axial passage communicating with one end of said chamber means remote from the displacer and said first chamber, a motor coupled to said slide for controlling movement of the displacer, said passage in said slide having a restriction, a valve having a fluid pressure responsive valve member for controlling flow the high and low pressure fluid to the displacer, means including a conduit communicating one end of said spool valve member with said one end of said chamber means for introducing high pressure fluid into the conduit to shift the spool valve member when the displacer is at one end of its stroke, a pilot valve controlling flow between said valve member and chamber means for reversing operation so that high pressure fluid is introduced into said conduit when said displacer is at the opposite end of its stroke, said pilot valve being responsive to the temperature in a cryopump cooled by said heat station.

* * * * *

UNITED STATES PATENT AND TRADEMARK OFFICE
CERTIFICATE OF CORRECTION

PATENT NO. : 4,388,809
DATED : June 21, 1983
INVENTOR(S) : Domenico S. Sarcia

It is certified that error appears in the above—identified patent and that said Letters Patent is hereby corrected as shown below:

Column 1, cancel line 66 and substitute:

"pilot valve shifted to a heating position."

Column 1, cancel line 68 and substitute:

"pilot valve and the spool valve shifted to a heating position."

Column 4, penultimate line, change "52'" to -62'-.

Column 6, line 38, after "flow" insert -of-.

Signed and Sealed this

*Twentieth* Day of *November 1984*

[SEAL]

*Attest:*

GERALD J. MOSSINGHOFF

*Attesting Officer*

*Commissioner of Patents and Trademarks*